United States Patent [19]

Tsao

[11] 4,198,212

[45] Apr. 15, 1980

[54] COAL GASIFICATION EFFLUENT TREATMENT

[75] Inventor: Utah Tsao, Jersey City, N.J.

[73] Assignee: The Lummus Company, Bloomfield, N.J.

[21] Appl. No.: 934,391

[22] Filed: Aug. 17, 1978

Related U.S. Application Data

[63] Continuation of Ser. No. 800,069, May 24, 1977, abandoned.

[51] Int. Cl.[2] ..... C10J 3/54

[52] U.S. Cl. ..... 48/210; 44/1 F; 122/5; 201/31

[58] Field of Search ..... 48/202, 206, 210, 203; 201/31, 2.5, 38; 44/1 F; 55/74; 252/373; 110/342; 122/5

[56] References Cited

U.S. PATENT DOCUMENTS

| | | | |
|---|---|---|---|
| 2,591,595 | 4/1952 | Ogorzaly | 48/210 |
| 2,687,950 | 8/1954 | Kalbach | 48/210 |
| 2,689,787 | 9/1954 | Ogorzaly et al. | 48/206 |
| 3,817,723 | 6/1974 | Donath | 48/210 |
| 3,852,048 | 12/1974 | Pyle | 201/2.5 |
| 3,991,557 | 11/1976 | Donath | 48/203 |
| 4,049,570 | 9/1977 | Gernhardt et al. | 48/210 |

FOREIGN PATENT DOCUMENTS

| | | | |
|---|---|---|---|
| 2541574 | 3/1977 | Fed. Rep. of Germany | 48/210 |

*Primary Examiner*—S. Leon Bashore
*Assistant Examiner*—Peter F. Kratz
*Attorney, Agent, or Firm*—Louis E. Marn; Elliot M. Olstein

[57] ABSTRACT

Coal is gasified to produce a coal gasification effluent and a char residue. The char residue is cooled by indirect heat transfer in a char bed, and the coal gasification effluent is passed through the cool char bed to effect cooling of the coal gasification effluent, with tars and oil present in the effluent being absorbed by the char bed. In this manner, the gasification effluent is cooled without fouling of heat transfer surfaces, and tars and oils are effectively removed therefrom.

8 Claims, 1 Drawing Figure

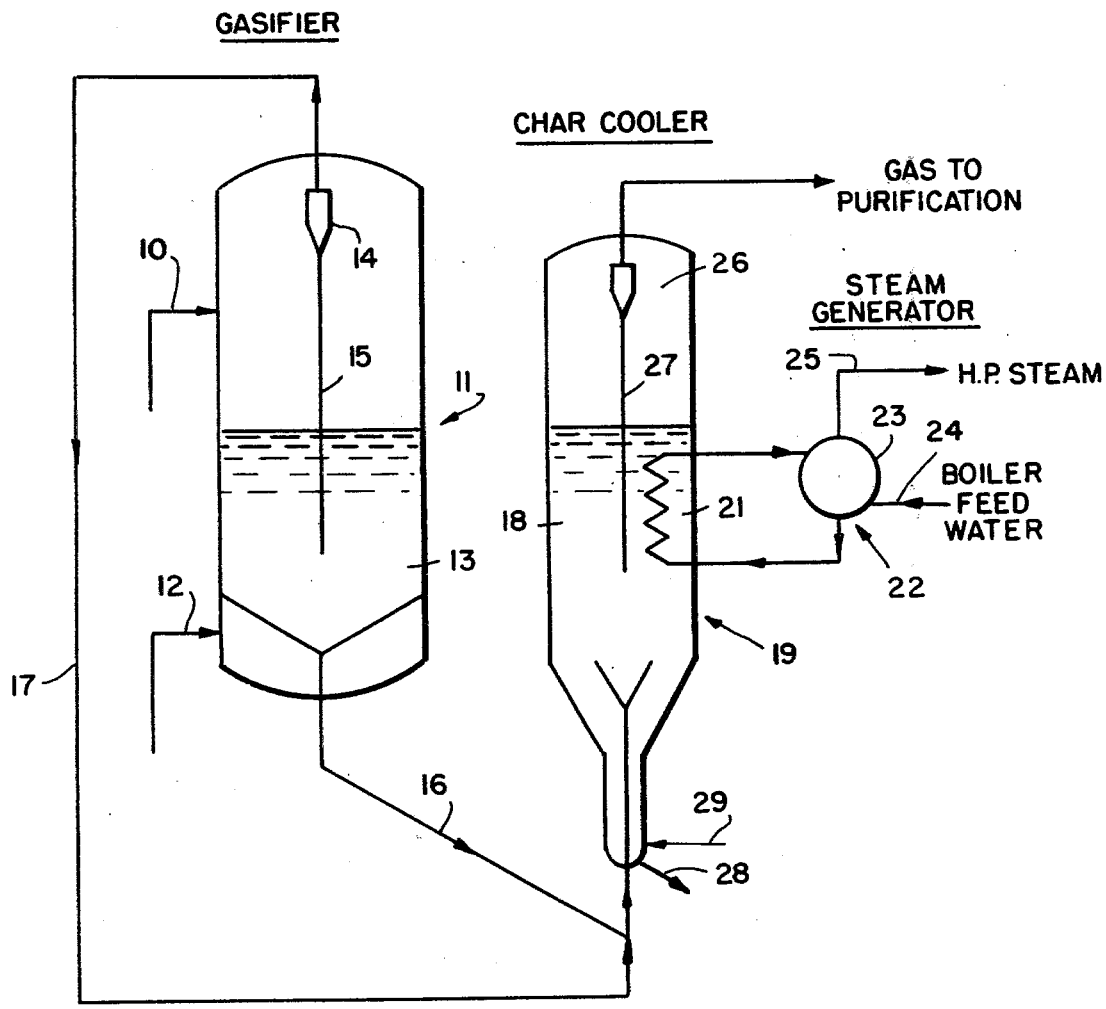
GASIFIER
CHAR COOLER
GAS TO PURIFICATION
STEAM GENERATOR
H.P. STEAM
BOILER FEED WATER
10
11
12
13
14
15
16
17
18
19
21
22
23
24
25
26
27
28
29

COAL GASIFICATION EFFLUENT TREATMENT

This application is a continuation of U.S. application Ser. No. 800,069 filed on May 24, 1977 now abandoned.

This invention relates to coal gasification.

In the gasification of coal, there is produced a gasification effluent and a char residue. The gasification effluent is cooled to effect heat recovery prior to effecting further processing thereof. The gasification effluent generally includes small amounts of tar and oil, as well as fines, and it has now been found that the presence of such tar, oil and fines present problems in the heat recovery and gas purification systems; namely, fouling of the heat transfer surfaces which adversely affects the heat recovery operation, and fouling of effluent gas quench and scrubbing equipment.

An object of the present invention is to provide for improved coal gasification.

Another object of the present invention is to alleviate problems encountered in the heat recovery and gas treatment portions of a coal gasification process.

These and other objects should be more readily apparent from the following detailed description of the present invention.

In accordance with the present invention, coal is gasified to produce a coal gasification effluent and a solid char residue. The solid char residue is introduced into a char bed, which is cooled by indirect heat transfer to effect cooling of the char residue. The high temperature coal gasification effluent is passed through the cool char bed to effect cooling of the coal gasification effluent, whereby the coal gasification effluent is cooled without coming into direct contact with the cooling surface of the heat recovery system. In addition, tars and oils present in the coal gasification effluent are absorbed by the char bed, whereby the troublesome tar and oil is removed from the gasification effluent.

More particularly, the coal is gasified in a coal gasification zone with a suitable coal gasification agent at coal gasification temperatures and pressures, as generally known in the art. The particular details of the coal gasification reaction form no part of the present invention and, accordingly, a detailed description thereof is not required for a complete understanding of the present invention. In accordance with a preferred embodiment, the coal gasification is effected in a fluidized coal gasification reactor wherein the coal is gasified in a fluidized coal bed with a suitable gasification agent; in particular, oxygen mixed with steam. In general, coal is gasified in a fluidized bed at a temperature of from 1200° F. to 2000° F., and preferably at a temperature of from 1400° F. to 1800° F., with the coal gasification pressure generally being in the order from about 10 to 1500 psig, and preferably from about 400 to about 1000 psig.

The coal gasification produces a char residue and a coal gasification effluent, with the coal gasification effluent generally containing hydrogen, carbon monoxide, carbon dioxide, methane, ethane, nitrogen, hydrogen sulphide, ammonia, water vapor, and small amounts of tar and oil. In accordance with the present invention, the char residue from the coal gasification is introduced into a char bed maintained in a char cooler, with the char bed being cooled by indirect heat transfer with a suitable heat transfer agent to effect heat recovery therefrom. In general, the cooled char bed is maintained at a temperature of from about 220° F. to about 600° F., preferably from about 300° F. to about 500° F., and at a pressure in the order from about 5 psig to about 25 psig, below the pressure of the coal gasification reactor. The coal gasification effluent withdrawn from the coal gasifier, at coal gasification temperatures, is passed through the cooled char bed to effect cooling of the coal gasification effluent by direct heat transfer with the cooled char bed to thereby effect heat recovery from the high temperature effluent. In general, the coal gasification effluent is cooled to a temperature in the order of from about 220° F. to about 600° F., and preferably from about 300° F. to about 500° F.

The invention will be further described with respect to an embodiment thereof illustrated in the accompanying drawing wherein:

The drawing is a simplified schematic representation of an embodiment of the present invention.

Referring now to the drawing, a pulverized coal feed in line 10, which is to be gasified, is introduced into a fluidized coal bed gasification reactor, schematically indicated as 11. A coal gasification agent; in particular, oxygen and steam, in line 12, is introduced into the lower portion of the gasification reactor 11, with the gasification agent also functioning to maintain the pulverized coal in bed 13 in a fluidized state. The coal gasification reactor 11 is operated at temperatures and pressures to effect gasification of the coal into a coal gasification effluent, and a char residue.

A coal gasification effluent, including tars and oils, is withdrawn from the coal gasification reactor 11 through a cyclone separator, schematically indicated as 14, to effect separation of fines therefrom, which are returned to the fluidized bed through line 15. A char residue is withdrawn from reactor 11 through line 16.

The coal gasification effluent in line 17 lifts the char in line 16 into the fluidized bed of char maintained in a char cooler, schematically indicated as 19. The coal gasification effluent is employed to maintain the char bed in cooler 19 in a fluidized state.

The char bed 18, in cooler 19, is cooled by a cooling coil 21, which forms a part of heat recovery system, schematically generally indicated as 22. The heat recovery system 22 includes a steam generator, generally indicated as 23, a source of boiler feed water, in line 24, and a high pressure steam outlet 25 for withdrawing steam produced in the generator 23. As should be apparent, coolant in the form of boiler feed water is circulated through the cooling coil 21, maintained in bed 18, resulting in cooling of the bed, and heating of the boiler feed water to recover heat from the gasification effluent and char by generating steam. In general, the heat recovery system generates steam at a temperature in the order from about 280° F. to about 550° F. at a pressure in the order from about 35 to about 1035 psig. Although the embodiment has been particularly described with respect to the use of a steam generation system, with a cooling oil embedded in the char bed, as should be apparent, it is possible to employ other heat recovery systems for effecting cooling of the char bed.

The char bed is maintained at a temperature, as hereinabove described, and a as a result, the coal gasification effluent is cooled by passage through the char bed 18 to a temperature in the order of from about 300° F. to about 500° F. In addition, the char bed absorbs tar and oils present in the gasification effluent, and the gasification effluent, containing tar and oils is not in contact with the cooling surfaces of the heat transfer system, thereby eliminating the fouling problems which heretofore occurred in the art.

The cooled gasification effluent is withdrawn from char cooler 19 through a cyclone separator 26 to separate any fines therefrom, which are returned to the char bed 18 through line 27.

Cooled char is withdrawn from the char cooler 19 through line 28 for further processing. The lower portion of the char cooler 19 is provided with steam, through line 29, to strip any entrained gas from the char.

The withdrawn char can be employed as fuel in a conventional boiler, and the tar and oil on the char is burned with the char. In this manner, the tar and oils are removed from the system without the necessity of effecting recovery thereof from waste water.

The present invention is particularly advantageous in that it is possible to cool the high temperature coal gasification effluent and effect recovery thereof without the problems heretofore encountered in the art as a result of fouling of the cooling and recovery surfaces. In addition, it is possible to remove troublesome tar and oils from the coal gasification effluent during such cooling.

In addition, the char is removed from the system at lower temperatures, thereby alleviating the problems heretofore encountered in withdrawing char from the high temperature high pressure coal gasification reactor.

These and other advantages should be apparent from the hereinabove description of the present invention.

Numerous modifications and variations of the present invention are possible in light of the above teachings and, therefore, within the scope of the appended claims, the invention may be practiced otherwise than as particularly described.

What is claimed is:

1. In a process for the gasification of coal in a coal gasification zone to produce a solid char residue and a coal gasification effluent containing tar and oils, the improvements comprising:

separately withdrawing said char and said coal gasification effluent from said coal gasification zone;

suspending said withdrawn char in said withdrawn coal gasification effluent;

passing said char suspended in said gasification effluent into a fluidized char bed maintained in a char cooling zone;

cooling and maintaining char in said bed at a temperature of from 220° F. to 600° F. by indirect heat transfer, whereby said coal gasification effluent, containing tar and oils, passing through said cooled char bed is cooled and tar and oils are separated therefrom by absorbing the tar and oils on said char bed; and removing cooled char from the coal gasification process without recycle of any cooled char to the coal gasification zone by withdrawing cooled char from said char bed, whereby char produced in the coal gasification is cooled prior to removal thereof.

2. The process of claim 1 wherein the char bed is cooled and maintained at a temperature of from 300° F. to 500° F.

3. The process of claim 2 wherein the char is steam stripped prior to withdrawal from the char cooling zone to strip entrained gases from the char.

4. The process of claim 3 wherein the withdrawn char is employed as fuel in a boiler.

5. The process of claim 2 wherein the coal gasification zone is a fluidized coal bed gasification reactor.

6. The process of claim 3 wherein the coal gasification zone is operated at a temperature of from 1200° F. to 2000° F. and a pressure of from 10 to 1500 psig.

7. The process of claim 6 wherein the char is cooled by indirect heat transfer with water to generate steam.

8. The process of claim 7 wherein the steam is generated at a temperature of from 280° F. to 550° F. and a pressure of from 35 to 1035 psig.

* * * * *